US006971355B2

(12) United States Patent
Roth

(10) Patent No.: US 6,971,355 B2
(45) Date of Patent: Dec. 6, 2005

(54) VARIABLE LIFT AND DURATION DEVICE FOR POPPET VALVES

(75) Inventor: David B. Roth, Groton, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 11/034,649

(22) Filed: Jan. 13, 2005

(65) Prior Publication Data

US 2005/0211203 A1 Sep. 29, 2005

Related U.S. Application Data

(60) Provisional application No. 60/557,184, filed on Mar. 29, 2004.

(51) Int. Cl.[7] ..... F01L 1/18

(52) U.S. Cl. ..... 123/90.39; 123/90.16; 123/90.44

(58) Field of Search ..... 123/90.16, 90.17, 123/90.31, 90.39, 90.44; 74/559, 569

(56) References Cited

U.S. PATENT DOCUMENTS

| | | | | |
|---|---|---|---|---|
| 4,523,550 | A | 6/1985 | Honda et al. | 123/90.16 |
| 4,526,142 | A | 7/1985 | Hara et al. | 123/90.16 |
| 4,986,227 | A | 1/1991 | Dewey, III | 123/90.16 |
| 5,365,895 | A | 11/1994 | Riley | 123/90.16 |
| 5,456,224 | A | 10/1995 | Riley | 123/90.16 |
| 5,572,962 | A | 11/1996 | Riley | 123/90.16 |
| 6,330,869 | B1 * | 12/2001 | Yoshiki et al. | 123/90.15 |
| 6,595,172 | B2 * | 7/2003 | Kabasin et al. | 123/90.16 |
| 2001/0037781 | A1 | 11/2001 | Fisher et al. | 123/90.24 |
| 2002/0166523 | A1 | 11/2002 | Kabasin et al. | 123/90.16 |
| 2003/0037635 | A1 | 2/2003 | Tsuchiyama et al. | 74/569 |
| 2003/0121484 | A1 | 7/2003 | Wang | 123/90.16 |
| 2003/0127063 | A1 | 7/2003 | Wang | 123/90.16 |
| 2003/0154940 | A1 | 8/2003 | Pierik | 123/90.16 |
| 2003/0209217 | A1 | 11/2003 | Hendriksma et al. | 123/90.44 |
| 2004/0003789 | A1 | 1/2004 | Kreuter | 123/90.16 |
| 2004/0020454 | A1 | 2/2004 | Koro et al. | 123/90.16 |

OTHER PUBLICATIONS

1999.Society of Automotive Engineers, Inc.; 1999-01-0329; Peter Kreuter et al; The Meta VVH System—The Advantages of Continuously Mechanical Variable Valve Timing; pp. 1-11.

SAE Technical Paper Series; 2000 World Congress; 2000-20-1224; Hara et al; Application of a Variable Valve Event and Timing System to Automotive Engines; pp. 1-8.

SAE 200 World Congress;.Flierl et al; 2000-01-1227; The Third Generation of Valvetrains—New Fully Variable Valvetrains for Throttle-Free Load; pp. 1-11.

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A device having a first and second rocker arm, and a control linkage. The first rocker arm has a first end receiving a first roller and a second end riding on a camshaft lobe. A second roller travels along an upper surface of the first rocker arm. The upper surface of the second rocker arm receives the first roller. When the control linkage is in a first position, the first rocker arm and roller slides along the upper surface of the second rocker arm towards the first end of the rocker arm, such that the valve head has maximum duration and lift from the valve seat. When the control linkage is in a second position, the first roller slides along the upper surface of the second rocker arm towards the second end of the rocker arm such that the valve head has minimum duration and lift from the valve seat.

6 Claims, 2 Drawing Sheets

VARIABLE LIFT AND DURATION DEVICE FOR POPPET VALVES

REFERENCE TO RELATED APPLICATIONS

This application claims an invention which was disclosed in Provisional Application No. 60/557,184, filed Mar. 29, 2004, entitled "Variable Lift and Duration Device For Poppet Valves". The benefit under 35 USC § 119(e) of the United States provisional application is hereby claimed, and the aforementioned application is hereby incorporated herein by reference.

BACKGROUND OF THE INVENTION

1. Field of the Invention

The invention pertains to the field of variable valve lifters. More particularly, the invention pertains to a variable valve lifter, which allows throttle-less engine load control.

2. Description of Related Art

Engine valves are most commonly opened and closed by actuation from a fixed camshaft lobe, and the resulting valve events are a compromise between the engine's valve event time requirements at high versus low engine speed. Recently, devices to vary the timing from that determined by a fixed-driven camshaft, have gone into production to enhance engine performance and emissions (by allowing controlled internal Exhaust Gas Recirculation). These devices are as simple as camshaft variable phasing devices, that control the angular position of the camshaft to the cam driving sprocket, to cam lobe switchers which switch valve actuation from one set of cam-lobe profiles to another.

These variable cam-timing systems offer significant enhancement in engine output over a wide engine speed range compared to fixed-timing naturally aspirated engines, and can functionally replace an EGR control valve at part-throttle. The one thing they do not have sufficient valve timing authority to accomplish eliminating the engine throttle. Electro-hydraulic and Electro-magnetic valve control systems do have the potential to allow for throttle-less engines, but these systems are strictly prototype systems that have significant cost, packaging, NVH, and energy-balance hurdles to overcome before they can be produced.

One example of prior art is U.S. Pat. No. 4,523,550 which shows a valve disabling device that has a cam means, and first and second rockers, where one of the rockers engages the cam. In both the first and second rocker arms are bores containing an engaging member and urging member. Pressure is applied to force the engaging member against the urging member, causing the first and second rockers arms to be drivingly coupled together and cause the inlet or exhaust valve to open in unison with each other.

U.S. Pat. No. 4,526,142 discloses a springy-like extension that is provided on a valve timing control lever which biases the valve against the valve stem until the rocker arm has been cammed to pivot a predetermined amount. The spring fingers are set to apply a predetermined preload on the valve stem via the rocker arm so that if the valve stem should elongate due to thermal expansion, the springy fingers will flex maintaining zero clearance.

U.S. Pat. No. 4,986,227 discloses a valve train that includes a rocker arm at one end engaging a cam, such that upward movement of the cam causes downward movement of the valve. The rocker arm has a convex fulcrum engaging upper surface extending between the rocker arm ends. The variable position fulcrum assembly includes a pivot arm, the lower end of which is pivotally mounted to a pivot point and the upper end of which carries a fulcrum roller engaging the fulcrum engaging upper surface of the rocker arm.

U.S. Pat. Nos. 5,365,895, 5,456,224, and 5,572,962 show a variable valve lift mechanism that has a pivot shaft and rocker arm, which have engaging teeth that mate. The pivot shaft rolls across a stationary rack of teeth to change the ratio of valve lift to cam lift. For each given position of the pivot shaft, the pivot shaft is prevented from rotating by riding in bearing block whose movement is constrained by a bearing guide of the same shape as the stationary rack. The relationship between adjustment clearance and pivot shaft position yields controlled variation of phase and duration. In U.S. Pat. No. 5,456,224 the path of contact between the rocker arm and the pivot may be circular or noncircular. In U.S. Pat. No. 5,572,962 the phase of the valve event is also varied by moving the pivot of the rocker arm and simultaneously altering the valve clearance during engine operation. The phase may also be varied by moving the rocker arm lengthwise at the same time that the pivot is moved.

U.S. 2001/0037781 discloses an elongated input shaft having a central axis. An input cam lobe disposed on the input shaft eccentric relative to the central axis. A guide member is pivotally mounted on the input cam lobe and is pivotally and slidably coupled to the guide member. An output cam is pivotally mounted on the input shaft and is also pivotally mounted to an end of a link arm. The other end of the link arm is pivotally coupled to the frame. The output cam is also configured for oscillating engagement of a roller of roller finger follower.

U.S. 2002/0166523 shows a variable valve actuator assembly comprising a primary rocker that includes a rotary roller, frame pivot pin, and a link pin. The rotary roller is attached and carried by the primary rocker. Rotation of a control member is transferred through the frame pivot pin to the corresponding rotation of the primary rocker relative to the camshaft. The rotation of the primary rocker is transferred through the link pin to rotation of the link. The oscillating cam pin transfers the rotation of the link to the rotation of the oscillating cam to establish the rotational position of the oscillating cam lobe relative to the follower roller. As the rotary cam is rotated by the camshaft, the rotary roller is displaced according to the lift profile of the input cam. The displacement of the rotary roller causes a corresponding displacement of the primary rocker.

U.S. 2003/0037635 shows a cam follower with a roller, where the body of the cam follower has a roller supporting portion integrated therein, a roller supporting shaft having both ends fixed to the roller supporting portion and a roller rotatably supported on the roller supporting shaft with a plurality of needle rollers interposed. At least one of the supporting shafts and the needle rollers has an added layer of nitrides to increase the surface hardness.

U.S. 2003/0121484 discloses that the pivot of the rocker arm assembly alters when a variable valve lift disc rotates. The variable rocker arm assembly is composed of two sets of arms, where one end of both arms rotates around the pivot and the other ends lay over each other and are separated by a spring. As the separation gap between the two arms changes, the amount of valve lift changes. The variable lift disc has engaging teeth that mate with a helical gear. The rocker arm shaft is mounted on the variable lift disc and when the disc rotates, it alters the rocker arm pivot position.

U.S. 2003/0127063 is similar to the above published application in that the lift and duration in the engine is achieved by altering the location of the pivot of the rocker arm. In this case a mechanical lash compensator is used.

U.S. 2003/0154940 shows a VVA mechanism that includes a frame member and rocker. The rocker includes a first end and a second end, with the first end being pivotally coupled to the frame. A link includes a first end and a second end, where the first end is pivotally coupled to the second end of the rocker arm by a first pin. A second pin pivotally couples an output cam to the second of the link. Either the first or second pin is eccentric.

U.S. 2003/0209217 shows a rocker arm assembly that includes a follower body for engaging a hydraulic lash adjuster and a valve stem. A central well contains a roller for following the central low-lift cam lobe. Pivotably mounted on the body are rollers for following the high-lift cam lobes. A latch below is disposed on the body surface and is slidably by piston between the first and second positions to latch and unlatch the high-lift followers.

U.S. 2004/0003789 discloses a variable valve lift comprising first and second cams, a cam follower, a valve lever, and a locking device. The cam follower may be defined on a mounted pin so that it can engage the first and second cams in an alternating manner. At a first rotational position, the cam follower operatively engages the first cam and generates the first amount of valve opening distance. At a second rotational position, the cam follower operatively engages the second cam and generates the second amount of valve opening distance. The valve lever transmits the first and second amounts of opening distances to the valve. The locking device locks the mounting pin and cam follower in the first or second rotational positions.

U.S. 2004/0020454 discloses a variable valve actuator that includes a control shaft and rocker arm. The second end of the rocker arm is connected to the control shaft. The rocker arm carries a roller for engaging the cam lobe. A link arm is pivotally coupled at a first end to the first end of the rocker arm. An output cam is pivotally coupled to the second end of the link arm and engages a corresponding cam follower of the engine. A spring biases the roller into contact with the cam lobe.

Another example is discussed in SAE Technical Paper 2000-01-1224, entitled "Application of a Variable Valve Event and Timing System to Automotive Engines." The paper discusses a variable valve event (VVE) system for a single or double overhead cam engine, where an offset between the centerline of drive disk and the camshaft centerline enables drive shaft torque to be transferred to the camshaft. A drive plate is fixed to a drive shaft. A radial slit is cut in the drive plate for receiving a drive pin. The drive shaft revolutions are transferred to the camshaft via the plates, pins, and drive disk. The drive disk de-centers linearly relative to the drive shaft. When the camshaft is driven when the drive shaft is de-centered, the rotation of the phaser of the camshaft relative to the drive shaft fluctuates and thus effects the open/closing timing of the valve. Using the VVE system of discussed in this paper, only the valve closing time or open time is variable, the open and closing timing are asymmetrically variable, or the opening and closing times are symmetrically variable.

SAE Technical Paper 1999-01-0329, entitled "The Meta VVH System—The Advantages of Continuously Mechanical Variable Valve Timing" consisting of two systems. The first system is the variable valve lift train and the second is the phasing device necessary to drive and shift the closing of the camshaft. The cam lobes of the valve train system are specially designed and the opening and closing valves each have rising and falling flanks. The open cam falling flank is a pre-loading flank and the closing cam rising flank is a gap flank. Both flanks are needed to complete the actuation cycle of the valves. The second system of the Meta VVH system consists of a pivoting monolevel where one end of the top surface contacts an opening cam and the bottom surface at the same end pushes on the intake valve rod with spring. The other end of the top surface has a spring and a roller. The roller is in contact with both the opening and closing cams.

SAE Technical Paper 2000-01-1227, entitled, "The Third Generation of Valvetrains-New Fully Variable Valvetrains for Throttle-Free Load Control" discloses an infinitely adjustable inlet valve lift by the addition of an intermediate lever. The intermediate lever is held in position by a shaft, the inlet camshaft, the roller cam follower, and the return spring. Depending on the rotation of the shaft, and rotation of the intermediate lever, minimum or maximum lift of the inlet valve occurs.

SUMMARY OF THE INVENTION

A variable lift and duration device for a valve having a first and a second rocker arm, and a control linkage. The first rocker arm has a first end receiving a first roller and a second end riding on a camshaft lobe. A second roller travels along an upper surface of the first rocker arm. The lower surface of the second rocker arm receives a lash adjuster and the valve stem of the valve. The upper surface of the second rocker arm receives the first roller. When the control linkage is in a first position, the first rocker arm and roller slides along the upper surface of the second rocker arm towards the first end of the rocker arm, such that the valve head has maximum duration and lift from the valve seat. When the control linkage is in a second position, the first roller slides along the upper surface of the second rocker arm towards the second end of the second rocker arm, such that the valve head has minimum duration and lift from the valve seat.

DETAILED DESCRIPTION OF THE INVENTION

Figure 1:
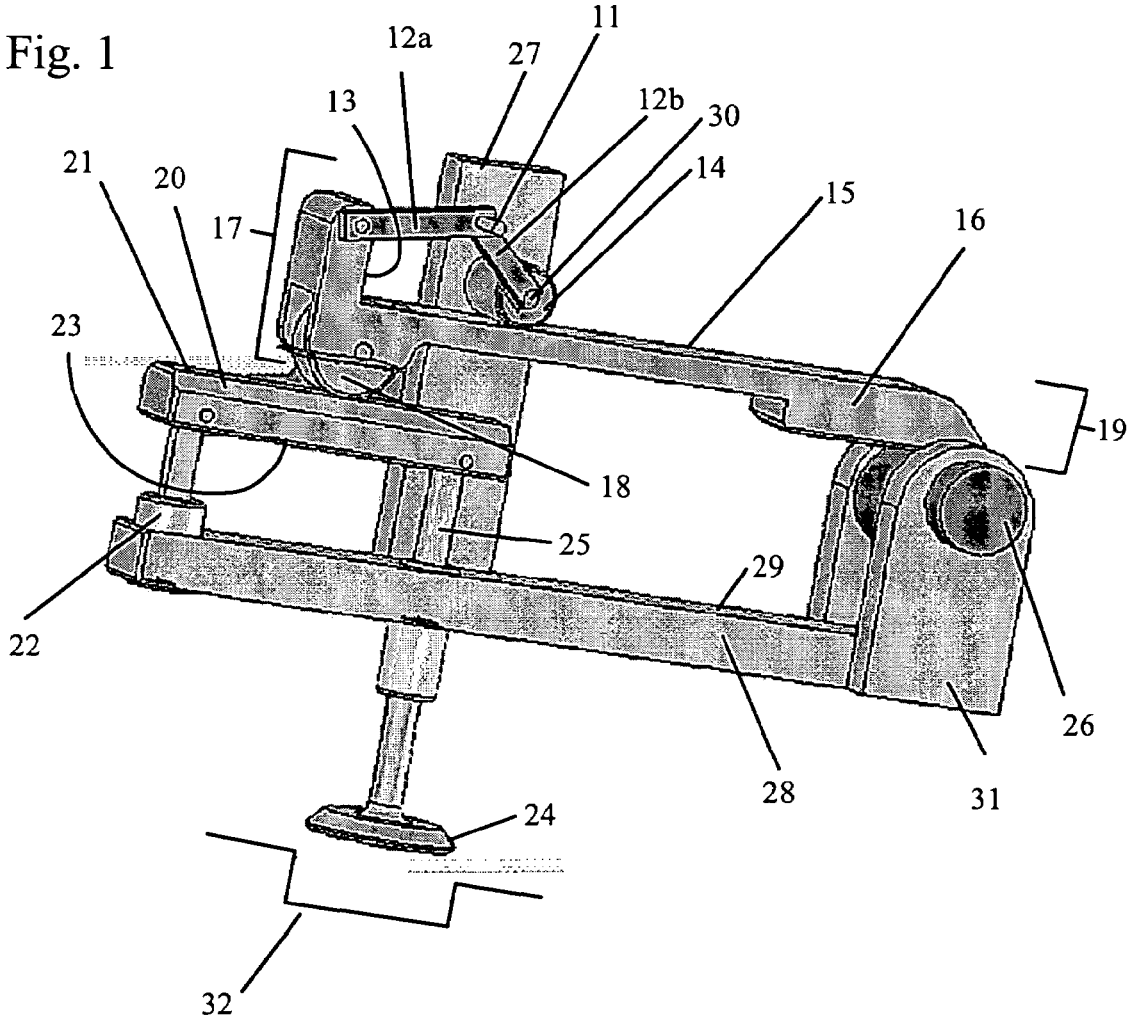
FIG. 1 shows the present invention in the near maximum lift and duration position.
Figure 2:
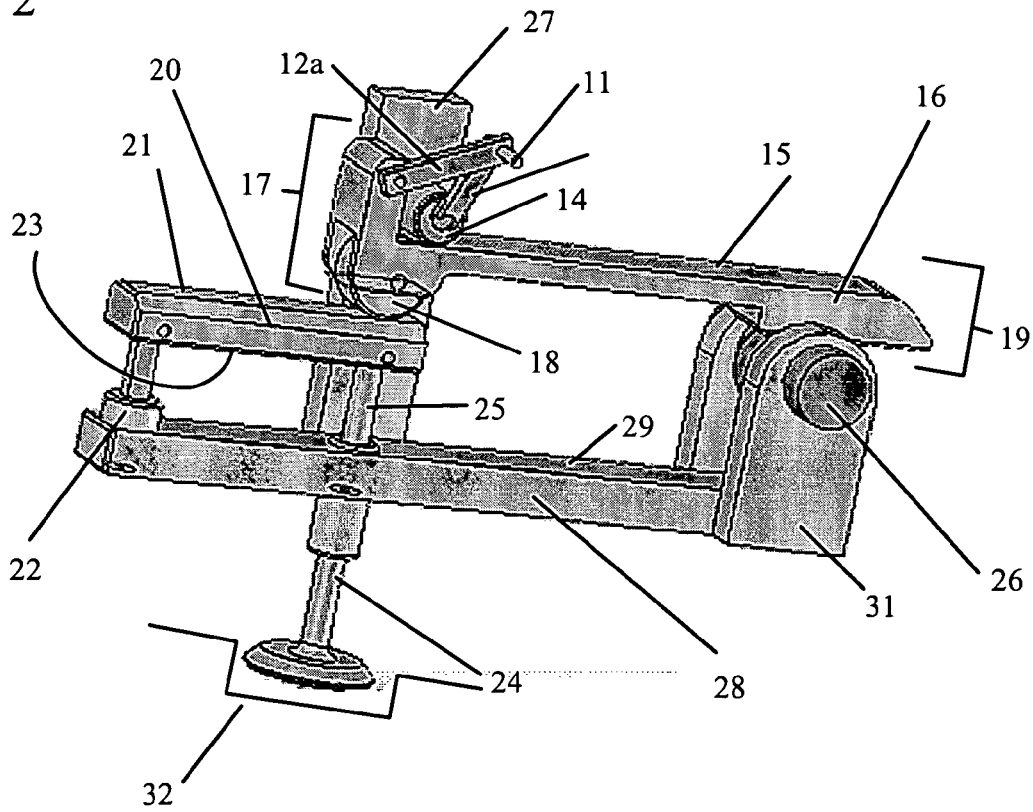
FIG. 2 shows the present invention in the minimal lift position.

FIGS. 1 and 2 show the maximum lift and the minimum lift of the variable valve lift device, respectively. A control rocker arm 16 has a cam end 19 that rides on camshaft 26 in cam block 31, a roller end 17, and an upper surface 15. A pivot shaft 30 is surrounded by a roller 14 and is attached to an upper end of roller end 17 of the control rocker arm 16 by a control linkage 12. The control linkage 12 is comprised of a first control linkage bar 12*a* with one end attached to the roller end 17 of the control rocker arm 16 and the other end attached to a second control linkage bar 12*b* by a pin 11. The other end of the second control linkage bar 12*b* is attached to pivot shaft 30. The pivot shaft 30 is fixedly attached to block 27.

The lower end of the roller end 17 of the control rocker arm 16 receives roller 18 which rides on an upper surface 21 of the end pivot rocker arm 20. Mountable attached to the lower surface 23 of the end pivot rocker arm 20 are a lash adjuster 22 and valve stem 25 of the poppet valve. Stabilizer shaft 28 receives lash adjuster 22 at one end, a valve stem 25 mounted to poppet valve head 24 and a cam block 31 mounted at a second end. The spring of the poppet valve is not shown for clarity. The poppet valve head 24 is received by valve seat 32.

The extension or retraction of the control linkage bars 12*a*, 12*b* moves the control rocker arm 16 along the camshaft 26 and roller 18 along the upper surface 21 length of the end pivot rocker arm 20. Specifically in the case of minimum lift and duration, as shown in FIG. 2, the control linkage bars 12*a*, 12*b* are retracted completely, such that roller 14 is flush against roller end wall 13 and roller 18 may be in line with valve stem 25. The position of the roller 18 along the upper surface 21 of the end pivot rocker arm 20 pushes the rod 25 against the valve spring (not shown) to move the valve head 24 to a minimum lift position from the valve seat 32.

The position of the control linkage bars 12*a*, 12*b* determines the lift and duration as a function of the cam lobe lift and duration based on different factors. The first factor is that as the control linkage bars 12*a*, 12*b* moves the control rocker arm 16 towards the lash-adjuster 22, the end-pivot rocker arm-ratio increases and the control rocker arm rocker-ratio also increases. The overall rocker ratio between the cam lobe 26 and the poppet valve is the product of these two ratios. Since both rocker ratios increase, the valve lift and duration will also increase rapidly as the control rocker arm 16 moves towards the lash adjuster 23 on the end pivot rocker arm 20. As shown in FIG. 1, in the maximum lift position, the control linkage bars are extended, moving the control rocker arm 16 and roller 18 away from the camshaft 26 or toward the lash adjuster 22 along the upper surface 21 length of the end pivot rocker arm 20. The force of the roller along the upper surface 21 of the end pivot rocker arm 20 is greater than the force of the valve spring (not shown) and the valve head 24 has maximum lift and duration. The hydraulic lash adjuster may be a fixed pivot with a mechanical lash adjuster, or alternatively the lash adjustment could be carried out on other interfaces between the control rocker arm 16 and the camshaft 26, control rocker arm 16 to end pivot rocker arm 20, or the end pivot rocker arm 20 and the poppet valve.

The second factor is that as the control linkage bars 12*a*, 12*b* moves the control rocker arm 16 away from the lash adjuster 22, the end-pivot rocker arm ratio decreases and the control rocker arm ratio also decreases. The overall rocker ratio between the cam lobe 26 and the poppet valve is the product of these two ratios. Since both rocker ratios decrease, the valve lift and duration will also decrease rapidly as the control rocker arm moves away from the lash adjuster 22 on the end pivot rocker arm 20. In FIG. 2, the end-pivot rocker arm ratio is roughly 1:1, and the control rocker arm ratio is very small. The minimum lift is small enough to allow for unthrottled engine idle, as well as total load control by this mechanism, thereby eliminating the need for a throttle. The net function of this system will be to scale the lift and duration of a cam lift curve up and down greatly. This mechanism may be combined with a camshaft variable-phasing device for maximum engine performance and control benefit. In this manner, engine performance, emissions, and fuel economy should all be improved compared to the fixed valve geometry valve train.

Alternatively, all or any of the rollers may be replaced with sliding interfaces and rocker arms, though shown as straight may be bent for packaging reasons. The interface between the control rocker arm and the control shaft may be a rack and pinion, where the rack is on the upper surface of the control rocker arm. This will eliminate the need for the control linkage bars, the pin, or the roller, since the rotation of the pinion on a shaft through the block will move the control rocker arm. Alternate linkage arrangements for the control linkage may also be used where the attachment point between the linkage and the cylinder head need not be concentric with the pivot-shaft.

The above embodiments are not just limited to poppet valves.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable lift and duration device of an internal combustion engine for opening and closing a valve, having a valve stem with a valve head mounted at one end, and a spring for biasing the valve head away from a valve seat in the engine, the device comprising:

a first rocker arm having a first end, an upper surface, and a second end, the first end receiving a first roller and having an extended wall projecting from the upper surface, the second end riding a top of a camshaft lobe;

a control linkage attached to the extended wall of the first rocker arm and a shaft fixedly attached to a block, the shaft receiving a second roller, which travels along the upper surface of the first rocker arm;

a second rocker arm having a first end, a second end, an upper surface, and a lower surface, the lower surface receiving a first end of a lash adjuster and the valve stem of the poppet valve, the upper surface receiving the first roller received by the first end of the first rocker arm;

wherein when the control linkage is in a first position, the first rocker arm and the first roller slides along the upper surface of the second rocker arm, towards the first end of the second rocker arm and the lash adjuster, such that the valve head has maximum duration and lift from the valve seat; and wherein when the control linkage is in a second position, the first rocker arm and the first roller slides along the upper surface of the second rocker arm, towards the second end of the rocker arm and away from the lash adjuster, such that the valve head has minimum duration and lift from the valve seat.

2. The variable lift and duration device of claim 1, wherein the lash adjuster is hydraulic.

3. The variable lift and duration device of claim 1, wherein the lash adjuster is mechanical.

4. The variable lift and duration device of claim 1, wherein the control rocker arm and the end pivot rocker arm are bent for packaging.

5. The variable lift and duration device of claim 1, further comprising a third arm for receiving a second end of the lash adjuster and the valve stem.

6. The variable lift and duration device of claim 1, wherein the second rocker arm is fastened to the block.

* * * * *